United States Patent [19]

Lindberg

[11] 4,183,712

[45] Jan. 15, 1980

[54] DEVICE IN LOADING CRANES

[75] Inventor: Hans E. Lindberg, Forsa, Sweden

[73] Assignee: HIAB-FOCO Aktiebolag, Sweden

[21] Appl. No.: 849,781

[22] Filed: Nov. 9, 1977

[30] Foreign Application Priority Data

Dec. 10, 1976 [SE] Sweden ..... 7613905

[51] Int. Cl.[2] ..... B66C 13/12

[52] U.S. Cl. ..... 414/738; 298/19 B; 414/680

[58] Field of Search ..... 214/130 R, 147 R, 512; 298/19 B; 414/680, 694, 729, 738

[56] References Cited

U.S. PATENT DOCUMENTS

| | | | |
|---|---|---|---|
| 3,125,235 | 3/1964 | Frangos | 214/512 |
| 3,220,698 | 11/1965 | Carder | 214/512 X |
| 3,367,512 | 2/1968 | Kaplan | 214/130 R X |

FOREIGN PATENT DOCUMENTS

| | | | |
|---|---|---|---|
| 215748 | 6/1958 | Australia | 298/19 B |
| 309735 | 8/1973 | Austria | 214/130 R |
| 20673 | 10/1955 | Fed. Rep. of Germany | 214/130 R |
| 308786 | 2/1969 | Sweden | 214/130 R |

*Primary Examiner*—L. J. Paperner

*Attorney, Agent, or Firm*—Newton, Hopkins & Ormsby

[57] ABSTRACT

In a loading crane comprising a crane post on which is pivotally mounted a crane arm or boom, and a main hydraulic piston-and-cylinder unit the lower end of which is pivotally connected to the base of the crane post and the upper end of which is pivotally connected to the inner crane arm end to effect raising and folding movements of said arm, a device, preferably in the form of an auxiliary piston-and-cylinder unit, arranged to displace the upper fulcrum of the main cylinder unit away from the crane post, past an imaginary line extending between the fulcrum pin on which the crane arm pivots relative to said post and the lower fulcrum point of the main cylinder unit.

1 Claim, 3 Drawing Figures

DEVICE IN LOADING CRANES

BACKGROUND OF THE INVENTION

In vehicle-mounted loading cranes, the hydraulic cylinder which serves to lift the crane arm is secured by one end to the crane post while the opposite end thereof is secured to the crane arm or boom at a distance from the point of attachment of the arm to the crane post. The point of attachment of the lifting cylinder to the crane arm in this case consists of the end of a pivotal lever the operative length of which is at its maximum when it is directed at 90° the lifting cylinder but which becomes smaller as this angle gets smaller or larger, i.e. when the crane arm pivots to its highest or lowest positions.

The product of the operative lever arm length and the power of the lifting cylinder gives the crane arm the required lifting moment. It is evident that the lifting moment is reduced when the lever arm is short and may cease completely, when the lever length approaches the value zero.

The crane arm should be capable of operating within an elevation range of appr. 160° and consequently its lifting capacity is limited at the upper and the lower parts of this range. However, it is necessary that the crane arm possesses sufficient lifting capacity also when it assumes its maximum and minimum angular elevation positions, both in order to be capable of lifting the load within the working area of the crane and also in order to be capable of lifting the crane arm to and away from a low parked position.

To solve this problem, various methods have been suggested. The one closest at hand is to use an excessively strong lifting cylinder, whereby the crane arm achieves sufficient lifting capacity in the extreme positions of its elevation area. However, the disadvantage of this arrangement is that the crane will be excessively strong also in more normal arm positions, with the possible consequence of overloading.

Another solution is disclosed in the Austrian Pat. No. 309,735 according to which a valve which is controlled by the pivotal movement of the air cylinder, serves to vary the pressure to the air cylinder, increasing it to the required extent to compensate for the reduced lever ratio.

The lifting cylinder could also be connected to a double link member as disclosed in the Swedish Pat. No. 308,786. Owing to this arrangement, the lifting arm is given a rather uniform lifting moment over the major part of the elevation area. However, double links of this kind, when used with large vehicle-mounted loading cranes, are so bulky that the loading tool cannot be parked on the vehicle proper without exceeding the maximum allowable vehicle width. For this reason, it has become necessary, when using cranes of this kind to arrange the crane post tiltable in relation to the crane base, allowing it to be folded to the position required to permit parking of the gripping tool within the allowable vehicle width. This arrangement is expensive and complicated.

SUMMARY OF THE INVENTION

The subject invention offers a novel and simple solution to the problem outlined above in connection with loading cranes designed in accordance with the indicated simple lever principle. In order to give the crane arm the required lifting moment at the highest elevation thereof, the point of attachment of the cylinder to the crane arm is positioned so low that the operative lever length will be sufficient to allow this. As the crane arm requires an elevation range of appr. 160°, it is appreciated that in the folded position ("parked position") the upper and lower attachment points of the lifting cylinder as well as the attachment point of the crane arm to the crane post may be in aligned or dead center relationship or even that the upper attachment point of the lifting cylinder will be positioned past this line in the direction towards the crane post, with the result that the moment arm will be zero or even negative, making it impossible to lift the crane arm from its folded (parked) position.

To move the crane arm from its parked position to a position wherein the lifting cylinder, in the following referred to as the main cylinder, will have sufficient lever length to provide the required lifting moment, the loading crane in accordance with the teachings of the subject invention incorporates an auxiliary device. When the crane arm is completely folded and the pivot axis between the main cylinder and the crane arm is positioned essentially on or internally of an imaginary line which extends between the fulcrum point of the arm and the fulcrum point of the main cylinder on the crane post, said device is arranged, upon or prior to application of a pressure in the main cylinder with a view to raise the crane arm, to displace the fulcrum point between the main cylinder and the crane arm away from the post over a distance ensuring that said fulcrum point will be positioned on the other side of the imaginary interconnection line.

In accordance with a preferred embodiment, the device consists of a second hydraulic piston-and-cylinder unit, in the following referred to as the auxiliary cylinder, which is mounted between the crane post and the crane arm without being pivotally attached thereto and, when the crane arm is in its completely folded position and a pressure is applied in the auxiliary cylinder, the latter cylinder is arranged to effect displacement of said fulcrum point between the main cylinder and the crane arm away from the crane post over a distance which is sufficient to ensure that a sufficiently long lever is obtained to allow the crane arm to be raised with the aid of the main cylinder.

This arrangement provides the advantage of making it possible to use the economic and simple lever principle that is offered by securing the crane arm to the crane post and yet obtain a sufficient lifting moment within the operational range of the crane arm without risking overloading. It likewise becomes possible, by adequately balancing the force and the operative length of the main cylinder, to allow a negative lever ratio, when the crane arm is folded to its maximum and thus allow the latter to pivot over an angle of nearly 180°, and yet obtain sufficient lifting power for handling goods and parking the crane arm within the elevational area of the latter.

BRIEF DESCRIPTION OF THE DRAWINGS

The invention will be described in closer detail in the following with reference to the accompanying, partly diagrammatical drawings, wherein.

DETAILED DESCRIPTION OF A PREFERRED EMBODIMENT

Figure 1:
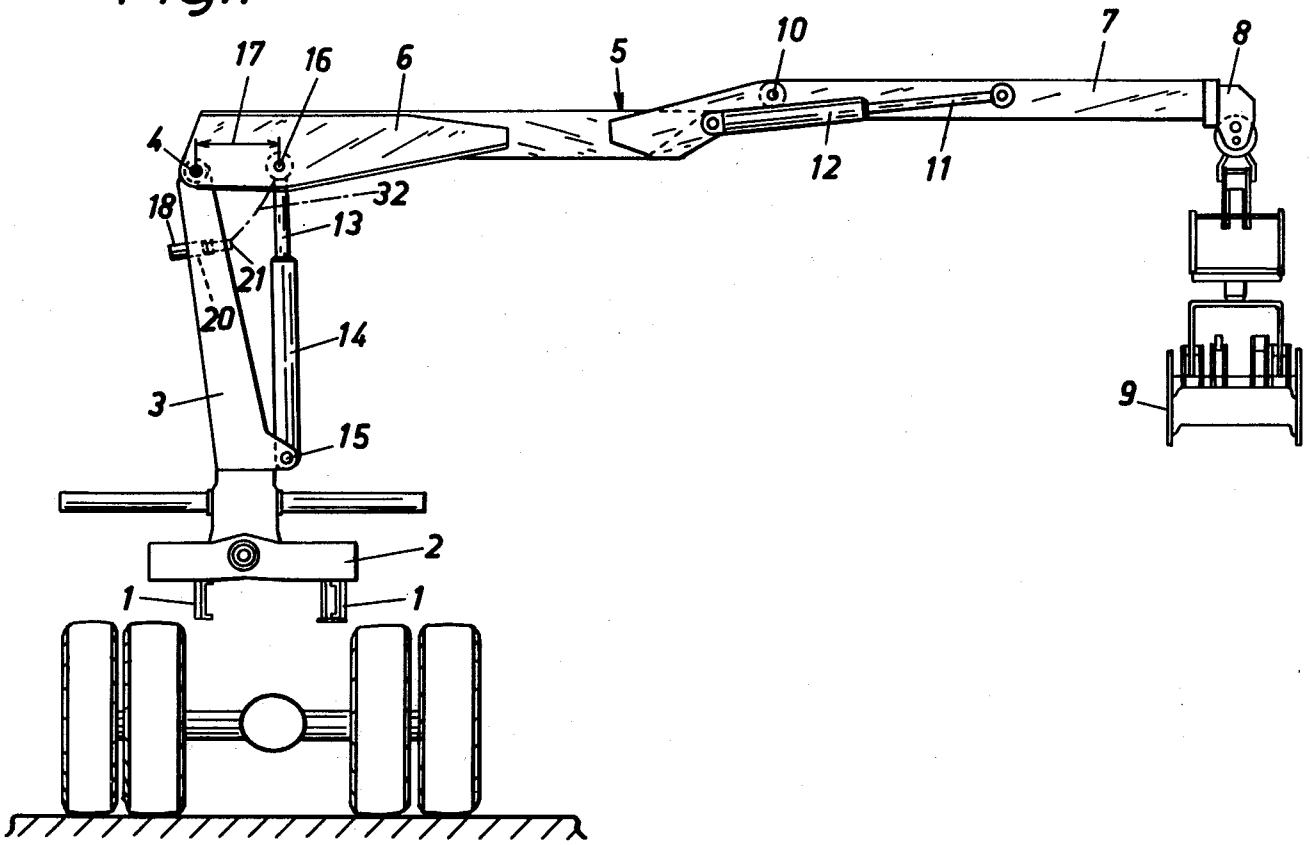
FIG. 1 is a rear view of a goods vehicle incorporating a loading crane equipped with the device in accordance with the invention and with the crane arm pivoted to an unfolded position.

The longitudinal beams 1 of the chassis frame of a goods vehicle support a crane base 2 on which is mounted a crane post 3 for pivotal movement about a vertical shaft. To the upper end of the crane post 3 is secured the inner end of a crane arm or boom 5 allowing the latter to pivot about a horizontal pin 4, said crane arm 5 comprising an inner arm 6 and an outer arm 7 which is equipped with an elongation arm 8 the outer end of which supports a gripping tool 9. The outer arm 7 is mounted for pivotal movement about a horizontal pin 10 at the outer end of the inner arm 6 and with the aid of a hydraulic piston-and-cylinder unit 11, 12 it may pivot in a vertical plane. The main piston-and-cylinder unit 13, 14 of the crane is articulated to the lower end of the crane post 3 by means of a pin 15 and to the inner arm 6 by means of a second pin 16 which is spaced from the fulcrum pin 4 by distance 17 (FIG. 1). Positioned opposite the fulcrum pin 16 when the crane arm 5 is in parked position (FIG. 3), the crane post 3 supports an auxiliary cylinder 18 in which a piston 19 is axially displaceable, the outer free end 21 of the piston rod 20 of said piston 19 abutting against the hub 22 which is arranged at the outer end of the piston rod of the main cylinder 13, 14. The auxiliary cylinder end facing the hub 22 is closed by a sleeve 23 through which displaceably passes the piston rod 20. Intermediate the sleeve 23 and the piston 19 is held a helical spring 24 which normally retains the piston 19 in the inner, inoperative position thereof (FIG. 3).

The end of the auxiliary cylinder 18 adjacent the piston 19 is by means of a hose 25 connected to a main hose 26 which by means of a hydraulic pump 27 forces hydraulic fluid from a container 28 to the lower end of the main cylinder 14. From the upper end of the main cylinder returned fluid is carried through a hose 29 back to the container 28.

Figure 2:
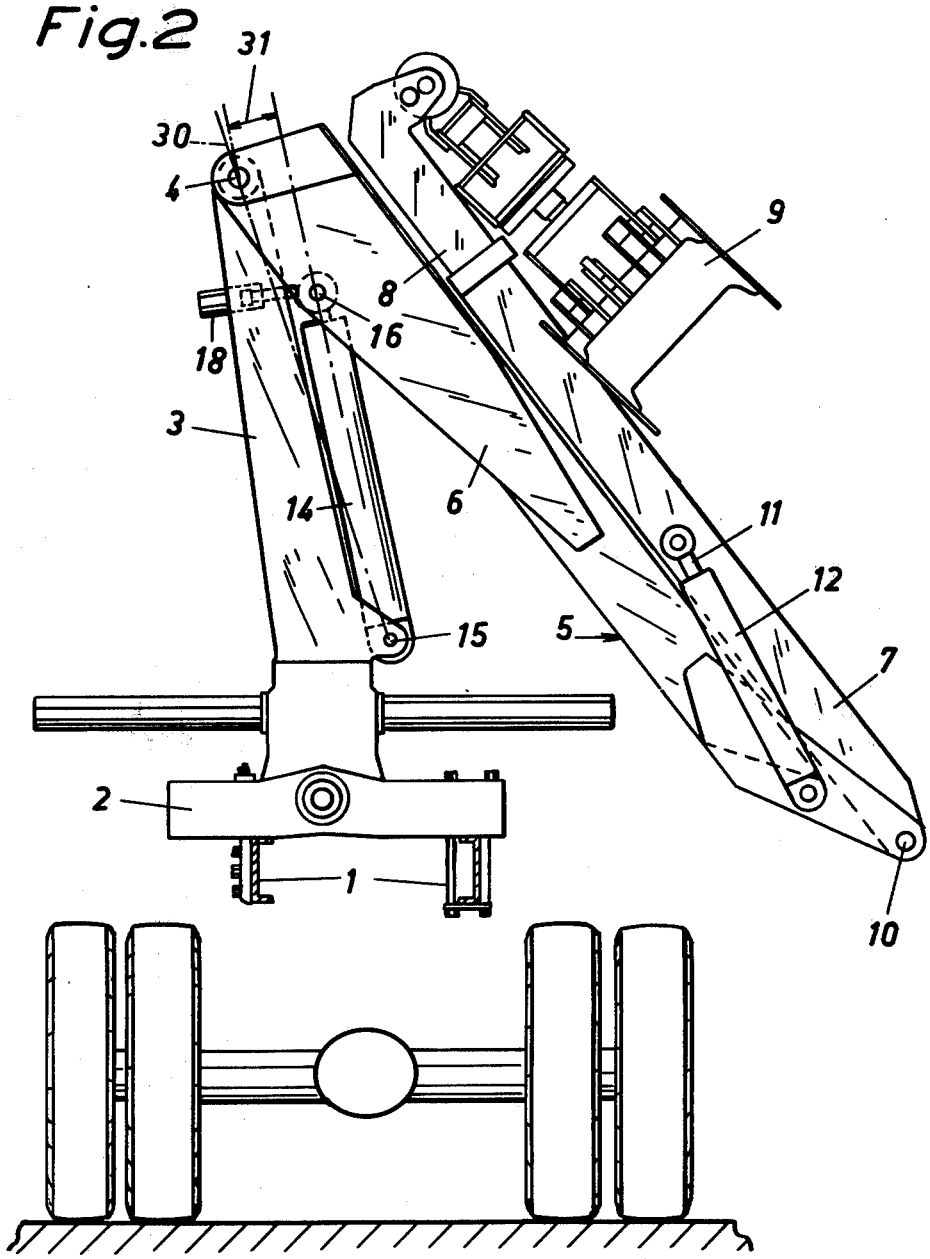
FIG. 2 illustrates on a somewhat enlarged scale a similar view but with the crane arm in a partly unfolded position.

When the crane arm 5 is to be raised from its parked position (FIG. 3) in which position the fulcrum pin 16 is positioned on (or possibly to the left of) an imaginary line 30 interconnecting the fulcrum pins 4 and 16, and a hydraulic pressure is applied in the main hose 26, the pressure is propagated via the hose 25 into the auxiliary cylinder 18. As a result, the piston rod 20 of the piston 19 pushes the fulcrum point 16 to the right, against the action of the helical spring 24, to the position shown in FIG. 2 while the inner arm is pivoted partly outwards. The resulting moment arm for the main cylinder 13, 14 is designated 31 in FIG. 2. The main cylinder is now able to pivot the inner arm 6 outwards to the operative position (FIG. 1) thereof with the aid of the hydraulic pressure in cylinder 14.

Figure 3:
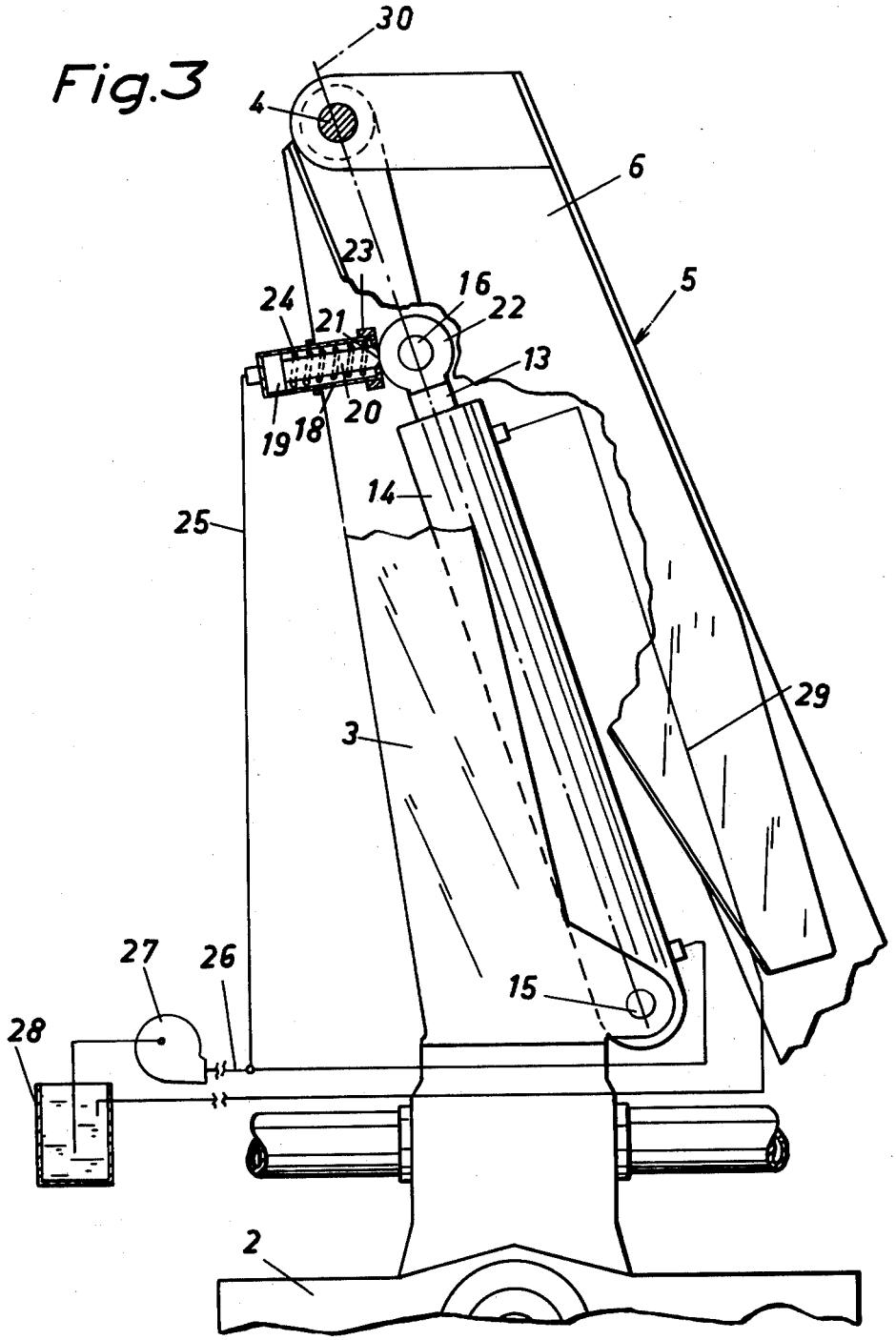
FIG. 3 illustrates on a further enlarged scale the loading crane components of FIG. 2 closest to the crane post with the auxiliary cylinder in position of rest or neutral position.

When the crane arm is to resume its parked position, following cease of pressure in hose 26, also the pressure in hose 25 and the auxiliary cylinder 18 ceases, for which reason the spring 24 is able to displace the piston 19 and the piston rod 20 to their initial positions (see FIG. 3).

For maximum efficiency of the auxiliary piston-and-cylinder unit 18, 19, 20 it should be positioned tangentially to a circular arc 32 as illustrated in the drawings, said arc having its centre in the pin 4 and having a radius which is equal to the distance 17 (FIG. 1) separating the fulcrum pins 4 and 16.

The embodiment as described and illustrated is to be regarded as an example only, and particularly the device designed to displace the fulcrum point 16 away from the crane post 3, when the crane arm 6 is to be pivoted outwards to its operative position with the aid of the main cylinder 13, 14 may be constructively altered in a variety of ways within the scope of the appended claims. The auxiliary cylinder 18, 19, 20 may be replaced by mechanical devices of identical purpose. As one example of such a mechanical device may be mentioned a sleeve which is rotatably mounted in the inner arm 6 and wherein the pin 16 may be eccentrically mounted with the result that upon rotation of the sleeve, e.g. by means of a handle, the pin 16 is displaced along a circular arc from a position closely adjacent the post 3 to a position further away therefrom, resulting in the moment arm designated 31 in FIG. 2. A similar effect could be obtained by using links disposed between the fulcrum pin 16 and the inner arm 6.

What I claim is:

1. In a loading crane, a generally upright post for movement around a vertical axis, a folding articulated crane boom including an inner section pivoted to said post for vertical swinging movement, a boom raising and lowering cylinder-piston unit having one end thereof pivoted to said post and having its other end pivoted to said inner section of the crane boom near but spaced somewhat from the pivotal connection between the post and said inner section, whereby when said boom is folded so that the inner section is in general parallelism with said post the axis of said cylinder-piston unit assumes substantially a dead center relationship with said pivotal connection and is unable to initiate raising of the crane boom toward a load handling position, a single small extensible and retractable power device only fixed on said post substantially perpendicular to the upright axis of the post somewhat below the pivotal connection between the post and said inner section, said single power device comprising a fluid pressure operated small cylinder-piston unit with the piston thereof including a rod extension having sliding contact with a hub element of said pivotal connection between said other end of the first-named cylinder-piston unit and said inner section of the crane boom, the operational axis of said small extensible and retractable power device being approximately tangent to the arc of a circle centered on the pivotal connection of said inner section of the boom with said post and with said arc intersecting the axis of the pivotal connection between said inner section and the boom raising and lowering cylinder-piston unit, said power device being operable to push said last-named pivotal connection laterally of the post sufficiently to move the axis of said cylinder-piston unit away from the dead center relationship with the pivotal connection between the post and the inner section of said boom.

* * * * *